United States Patent [19]

Lupoli et al.

[11] Patent Number: 4,650,936

[45] Date of Patent: Mar. 17, 1987

[54] ELECTRIC SWITCH CONSTRUCTION

[75] Inventors: Peter J. Lupoli, Hamden; Donald J. Mattis, Norwalk, both of Conn.

[73] Assignee: Casco Products Corporation, Bridgeport, Conn.

[21] Appl. No.: 822,531

[22] Filed: Jan. 27, 1986

[51] Int. Cl.[4] ..... H01H 3/16; H01H 13/64; H01H 15/06; H01H 9/02

[52] U.S. Cl. ..... 200/16 B; 174/51; 200/1 B; 200/61.76; 200/159 R; 200/276

[58] Field of Search ..... 200/1 R, 1 B, 6 R, 6 B, 200/6 BA, 16 A, 16 B, 61.62, 61.76–61.79, 156, 159 R, 160, 276, 294, 295, 296; 174/51

[56] References Cited

U.S. PATENT DOCUMENTS

| | | | |
|---|---|---|---|
| 1,974,910 | 9/1934 | Bondeson | 174/51 |
| 2,118,672 | 5/1938 | Green | 174/51 |
| 2,317,727 | 4/1943 | Bonanno | 200/1 B |
| 2,528,520 | 11/1950 | Jackson et al. | 200/156 X |
| 2,921,155 | 1/1960 | Basso | 200/61.76 X |
| 3,141,936 | 7/1964 | Boyle et al. | 200/276 X |
| 3,172,981 | 3/1965 | Loesch | 200/61.76 X |
| 3,211,872 | 10/1965 | Baer | 200/276 X |
| 3,710,048 | 1/1973 | Schumacher | 200/16 B X |
| 3,792,219 | 2/1974 | Rowley | 200/276 X |
| 4,022,999 | 5/1977 | Brown | 200/6 BA X |
| 4,308,440 | 12/1981 | Buttner | 200/16 B X |
| 4,319,106 | 3/1982 | Armitage | 200/160 X |
| 4,476,359 | 10/1984 | Bienwald | 200/156 |

*Primary Examiner*—J. R. Scott
*Attorney, Agent, or Firm*—Mitchell D. Bittman

[57] ABSTRACT

An electric switch construction having a housing with electric terminals, two concentric springs disposed in the housing and respectively connected with the terminals, and a movable contactor cup adapted to establish continuity between the terminals and a conductive, barrel portion of the housing. The outer spring biases the cup to a circuit-closing position wherein both terminals are connected to the barrel portion of the housing. A manually-engageable plunger is arranged to engage the cup. When the plunger is actuated, first one terminal is disconnected from the barrel portion of the switch, and subsequently, upon further movement of the plunger, the remaining terminal is disconnected therefrom. The plunger carries an O-ring which forms a partial seal along the bore of the housing, so as to minimize the accumulation of dirt or moisture from the surfaces where electrical contact is made or broken. As the switch is operated, the plunger tends to rotate the cup in small increments, such that different contact points on the cup are presented to the cooperable surface against which the cup is seated. As a result, improved conductivity is had over extended periods of use. In addition, the seal of the switch minimizes problems that normally occur in harsh environments such as are encountered in the automotive field.

18 Claims, 30 Drawing Figures

ELECTRIC SWITCH CONSTRUCTION

BACKGROUND

This invention relates to electric switching devices, and more particularly to switching devices which incorporate a plunger-type actuator in order to effect the make and break operations. The invention is considered to have special utility in the automotive field, where typical switch devices are subjected to extremes of temperature, humidity and rough handling, and yet are expected to operate satisfactorily over extended periods of time.

In the past numerous push-button type electric switches have been proposed and produced, meeting with varying degrees of success. Many such devices were employed in automotive vehicles in conjunction with the vehicle's doors, being installed in the door jamb in order to operate courtesy lights, etc. Still others found wide acceptance for use with the vehicle's hood and trunk compartments, in order to indicate various conditions, such as when the hood was not fully latched, or for triggering alarm circuitry if unauthorized entry into the vehicle was attempted.

Frequently these switches were simple make-and-break devices, having normally closed circuits, with the contacting surfaces at least partially exposed. Under such circumstances there was a tendency for moisture, salt, dirt and sand or other debris to become lodged in the switch mechanism, causing either erratic operation, deterioration, or eventual failure. Efforts to prevent the accumulation of such matter by means of sealed switch casings, have not led to much commercial success for the reason that the expense involved in providing an effective seal was not warranted, despite the multiple units that were employed on newer model vehicles. Yet it was considered important that such switches be reliable in operation, and not subject to breakdown under the extreme environmental conditions to which vehicles are typically subjected. Compromise constructions in general left something to be desired, considering the objectives of economy and useful life under adverse operating conditions.

Manual operation of plunger-type switches normally presents few problems as regards the extent of movement of the plunger, or the forces intended to be applied to the plunger. That is, the operator merely depresses the plunger or push button with a moderate force, until the desired circuit is energized, etc. However, with plunger-type switches that are intended to be automatically actuated by engagement of the switch plunger by a relatively massive member, such as the hood, trunk lid, or door of a vehicle, there arise problems in insuring that the physical dimensions and tolerances of the switch are in accord with the space requirements dictated by the particular application. Specifically it is necessary to insure that the plunger is not subjected to excessive force or impulses, since this could result in permanent damage to either the plunger, the switch housing, or the contact mechanism in the housing.

Accordingly there has been a long-felt need for a sturdy and reliable inexpensive switch which would perform satisfactorily under the circumstances noted above, and which would eliminate the problems that often plagued many of the prior switch arrangements.

SUMMARY

The above drawbacks and disadvantages of prior electric switch devices are obviated by the present invention, which has for one object the provision of a novel and improved electric switch which is extremely simple in its construction, while at the same time being both rugged and reliable over extended periods of use.

A related object of the invention is to provide an improved switch as above set forth, wherein an effective seal is had at strategic points, wherein basic components can be constituted largely of molded plastic, and wherein such parts can be fabricated in relatively simple mold cavities.

Still another object of the invention is to provide an improved electric switch as above characterized, wherein the assembly of the various components can be readily accomplished by automated equipment, thereby reducing the overall manufacturing cost and minimizing operator-related error.

Yet another object of the invention is to provide an improved electric switch of the kind indicated, wherein the surfaces of the conductors that establish the contacts are largely isolated from the environment through the use of a housing that is for the most part sealed, thus minimizing deterioration of the contacts that might otherwise result from the presence of dirt, moisture or other debris.

A still further object of the invention is to provide an improved electric switch as outlined above, wherein the terminals adapted for external connection to an electrical receptacle are disposed in a protective housing, and wherein provision is made for accepting a boot-type connector, so as to minimize accumulation of debris on the terminals themselves, with resultant deterioration of the electrical connection.

A further object of the invention is to provide an improved electric switch in accordance with the foregoing wherein one of the movable contacts is turned about an axis as it is engaged by the switch actuator mechanism, thereby presenting different contact points to the corresponding surface areas of the cooperable contact.

Still another object of the invention is to provide an improved electric switch as outlined above wherein the length of the switch plunger is automatically calibrated to fit the environment in which the switch is employed, thereby eliminating the likelihood of damage to the switch as a result of excessive forces being applied to the switch plunger, as for example by the hood or trunk lid of a motor vehicle.

The above objects are accomplished by the provision of an electric switch construction comprising a housing, means insulatedly mounting a pair of electrical terminals in the housing in side-by-side relation to one another, a pair of compression, electrically-conducting coil springs in the housing disposed coaxially one within the other, together with means carried by the housing, electrically respectively connecting one pair of corresponding ends of the springs to the terminals. There is also provided a movable electrically-conducting abutment means detachably electrically connecting the other pair of corresponding ends of the coil springs to each other and being movable between circuit closing and circuit opening positions. An electrical conductor on the housing is adapted for engagement with the abutment means to effect electrical connection therewith when the abutment means is in its circuit closing position. The conductor is intended for use as a common carrier for currents passing through the abutment means and terminals. In addition, there are manually-operable means on the housing, movable between circuit opening and circuit closing positions and engageable with the abutment means to shift the latter to its circuit opening position. The arrangement is such that the abutment means closes a circuit between the conductor and the said other pair of spring ends at the time that it is in engagement with the conductor whereby current can thus flow from the terminals to the conductor; the abutment means is involved with breaking the associated circuits when it is separated from the conductor by the manually-operable means.

The objects are further accomplished by the provision of an electric plunger switch comprising a switch housing, a pair of electrical contacts mounted by the housing, and switching means in the housing for electrically connecting and disconnecting the contacts from one another. There is a two-part plunger carried by the housing and moveable with respect thereto, the plunger being engageable with the switching means. One of the plunger parts has an interference friction fit with the other part. The one part extends into the switch housing and has an abutting engagement therewith, and the other of the parts has shoulder means engageable by an actuator member. The arrangement is such that any excessive force applied to the other plunger part by the actuator member effects a predetermined retraction of such part with respect to the one part after the abutting engagement has been effected, thereby to automatically calibrate or adjust the effective length of the plunger to a predetermined working measurement and reduce the likelihood of damage to the plunger and switch housing.

Other features and advantages will hereinafter appear.

BRIEF DESCRIPTION OF THE DRAWINGS

In the drawings, illustrating preferred embodiments of the invention:

FIG. 7 is a left end elevation of the plunger of FIG. 6.

DESCRIPTION OF THE PREFERRED EMBODIMENT

Figure 1:
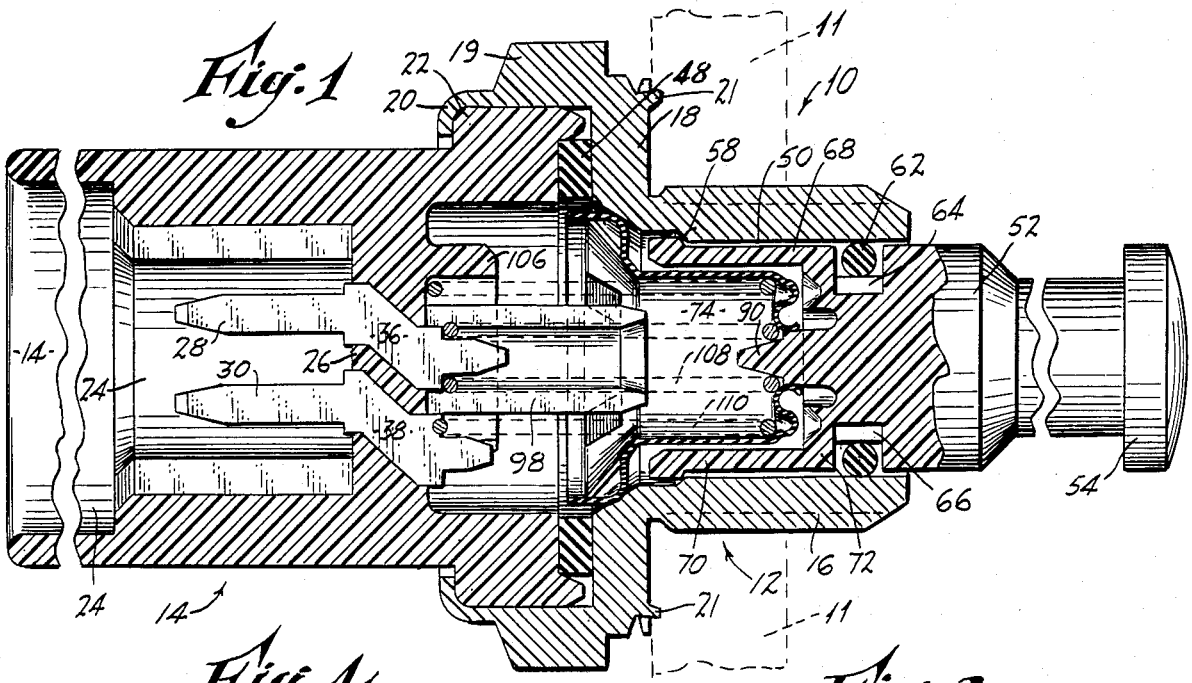
FIG. 1 is a fragmentary axial section of the improved switch construction of the present invention, showing the various parts in a circuit closing position.
Figure 2:
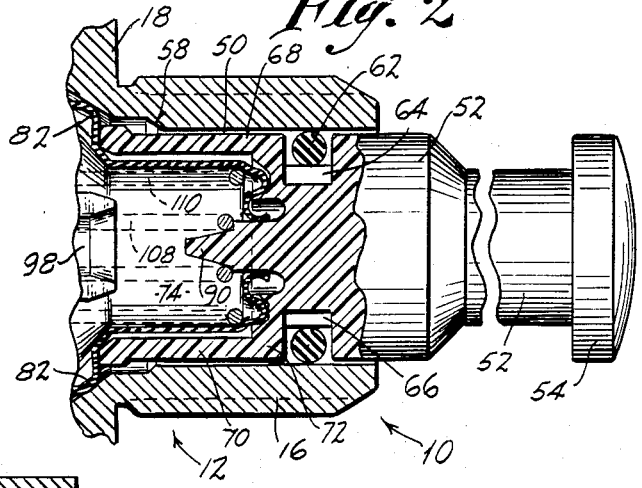
FIG. 2 is a fragmentary axial section of the switch of FIG. 1, with the actuator plunger having been initially depressed part way toward its fully circuit opening position.
Figure 3:
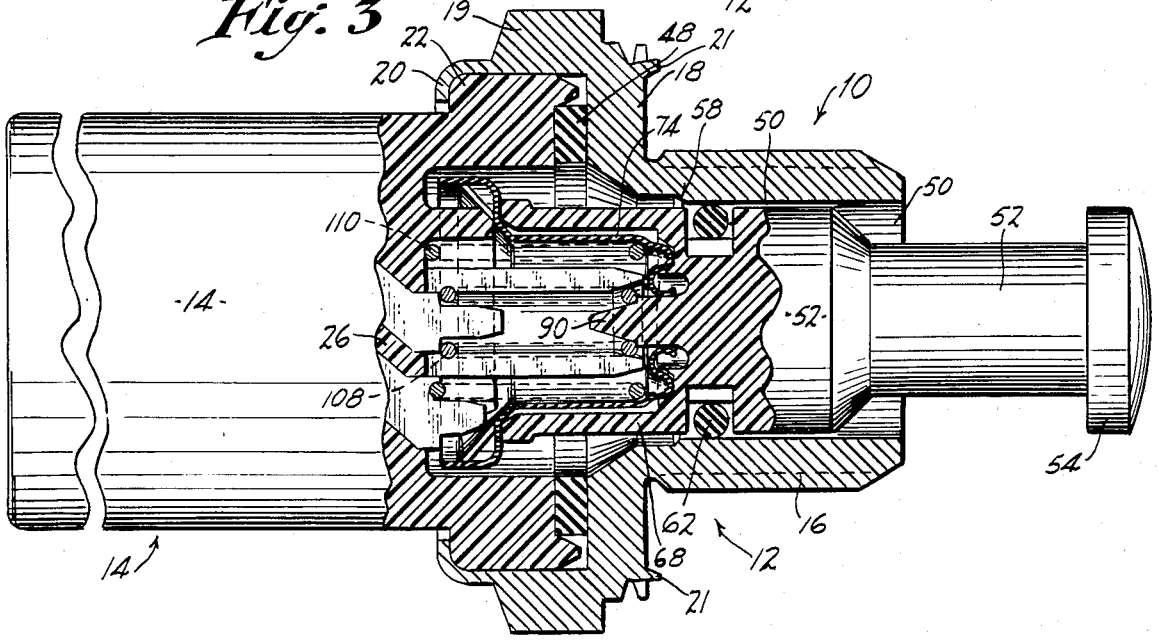
FIG. 3 is a similar view, partly in axial section and partly in elevation, showing the plunger of the switch in a fully depressed, circuit opening position.
Figure 1:
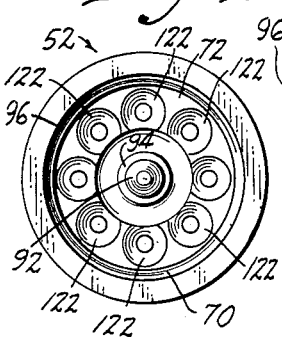
Figure 13:
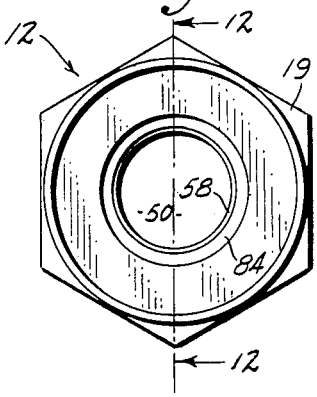
FIG. 13 is a left end elevation of the housing portion shown in FIG. 12.
Figure 12:
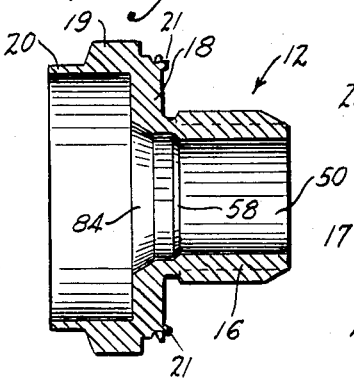
FIG. 12 is an axial section of a contactor portion of the housing of the switch of FIGS. 1–3. The view is taken on the line 12—12 of FIG. 13.
Figure 14:
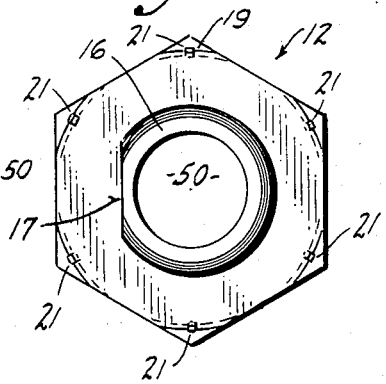
FIG. 14 is a right end elevation of the housing portion shown in FIGS. 12 and 13.

Referring to FIGS. 1–3 and in accordance with the present invention there is provided a novel and improved switch mechanism adapted to be carried on a mounting panel 11 which can be a flat metal plate, channel, strut, beam, or other electrically-conductive structural member. The panel is shown in FIG. 1 in dotted outline. The switch is generally designated by the numeral 10 and comprises a two part housing, one part 12 being constituted of metal and the other part 14 of molded plastic or other insulating material. The metal part 12 is particularly shown in FIGS. 12–14, comprising a threaded barrel 16 and an integral flange 18 having a hex-configuration 19 engageable by a suitable wrench, to hold the flange stationary and thereby enable able a nut (not shown) to be applied to the barrel. The metal housing part 12 has an annular flange 20 that is curled over an annular shoulder 22 on the molded housing part 14 so as to permanently retain the two in assembled relation. Optionally, the threaded barrel 16 can have a flat 17 to enable the barrel to be inserted into a D-shaped hole and thereby keyed against rotation.

In accordance with the invention, the surface of the flange 18 is provided with a plurality of sheared metal teeth 21, shown as being six in number, which are formed by a suitable shear tool (not shown). The teeth 21 project above the surface and will thus tend to puncture or break through any paint, oxidation, or other non-conductive film on the mounting surface for the switch. Thus, a good electrical contact will be established between the metal part 12 and such mounting surface 11 when the nut is assembled onto the barrel and tightened. These teeth are shown in FIGS. 1, 3, 12 and 14. They are integral with the remaining parts of the flange, having been formed by shearing, as noted above.

Figure 15:
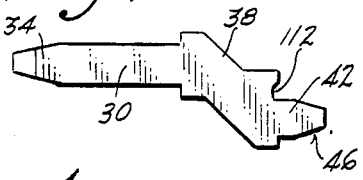
FIG. 15 is a plan view of the other of two terminals and connector means employed in the switch of FIGS. 1–3.
Figure 16:
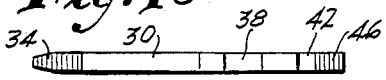
FIG. 16 is an edge view of the terminal and connector means of FIG. 15.

The molded housing part 14 is particularly illustrated in FIGS. 17–20. The part is in the form of an insulating block, and has a cavity or recess 24 adapted to accept an electrical receptacle connector (not shown) preferably of a type having a boot that seals the recess 24 from the exterior of the housing, thereby preventing dirt or other debris from entering. The molded housing part 14 is made with a transverse bottom wall 26 in which there are embedded two terminals 28 and 30 respectively, the terminal 28 being particularly shown in FIGS. 4 and 5 and the other terminal 30 being illustrated in FIGS. 15 and 16. The terminals 28 and 30 are preferably constituted of flat, stamped metal, and have tapered outer end portions 32 and 34, respectively. The angularly disposed portions of the stampings, embedded in the transverse wall 26, are indicated by the numerals 36 and 38, with the inner portions of the stampings labelled 40 and 42. These inner portions are also tapered, as at 44, 46 respectively to provide a lead-in for seating compression coil springs to be described below. The housing part 14 has another recess 47 on the opposite side of the transverse wall 26.

Figure 21:
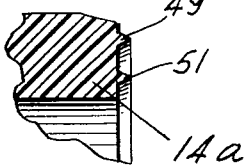
FIG. 21 is a fragmentary axial section of a modified molded plastic housing portion, for substitution in the switch device of the previous figures.
Figure 17:
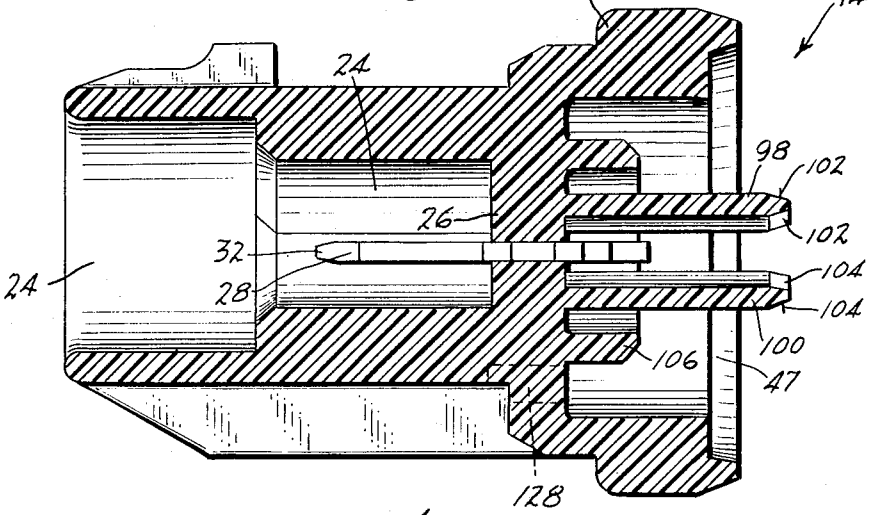
FIG. 17 is an axial section of a molded plastic portion of the housing of the switch of FIGS. 1–3.

Disposed between the housing parts 12 and 14 is a sealing gasket 48, which is compressed slightly during assembly in order to provide a seal of the interior of the housing as will be explained below. In place of the gasket 48, the housing part 14 can be provided with one or two annular upstanding beads 49, 51 which have relatively sharp crests and which are intended to crush slightly when the housing portions are assembled. The beads thus constitute a seal between such portions. Such a modification is shown in FIG. 21.

Figure 6:
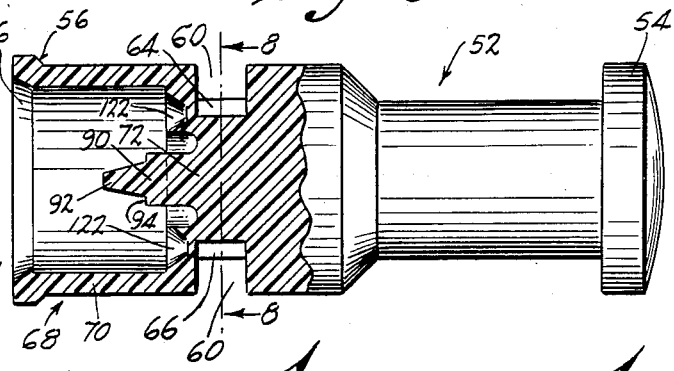
FIG. 6 is a view, partly in axial section and partly in elevation, of the plunger employed in the switch of FIGS. 1–3.
Figure 8:
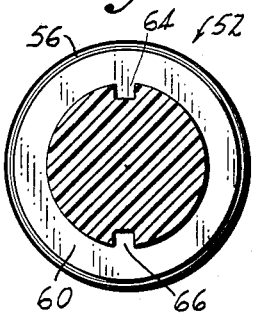
FIG. 8 is a section taken on the line 8—8 of FIG. 6.

The housing part 12 has a bore 50, and slidably carried therein is a plunger or push button 52 having a knob 54 and a retainer shoulder 56, FIG. 6, that is intended to be engaged by a cooperable internal annular shoulder 58 in the bore 50. The knob 54 can be omitted, if desired, in which case the plunger would assume a cylindrical configuration (not shown) at its outer end. Spaced from the inner end of the plunger is an annular transverse external groove 60 which receives an O-ring 62. The latter provides a seal against the walls of the housing bore 50; in order to reduce resistance to axially inward movement of the plunger which might otherwise result as the air in the bore is compressed, small by-pass passages are preferably incorporated in the plunger, adjacent the location of the O-ring. Two such passages 64 and 66 are illustrated. These passages permit a limited venting of air from the interior when the plunger 52 is initially depressed, and also allow air to re-enter the bore 50 when the plunger 52 is released. In the absence of such passages, it is possible that the piston effect of the plunger 52 might interfere with its free movement and lead to poor functioning and perhaps undue stresses on the switch housing parts 12 and 14.

Figure 10:
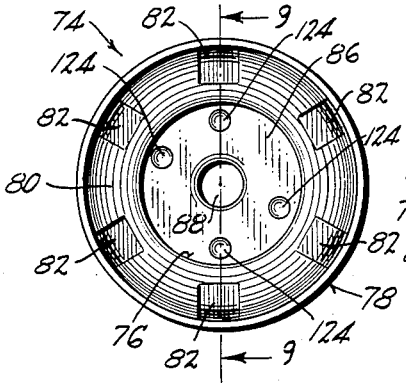
FIG. 10 is a left end elevation of the cup of FIG. 9.
Figure 9:
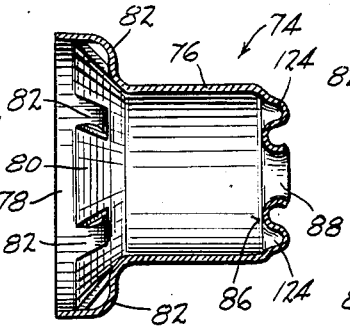
FIG. 9 is an axial section of the contact cup or movable abutment member employed in the switch of FIGS. 1–3. The view is taken on the line 9—9 of FIG. 10.
Figure 11:
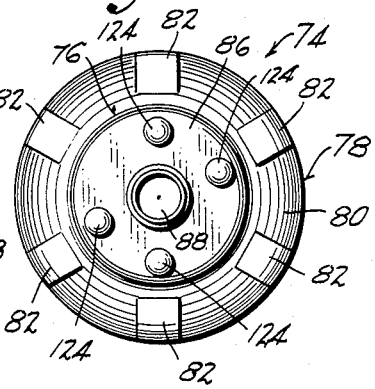
FIG. 11 is a right end elevation of the cup of FIGS. 9 and 20.

Referring again to FIGS. 1–3 and 6–8, the plunger 52 has a cup formation 68 at its inner end, with an annular side wall 70 and a transverse bottom wall 72, the cup formation 68 being adapted to provide a seat and axially slidable guide for a rotatably movable switching abutment means which is electrically conductive and which comprises a metal contactor cup 74. The metal cup 74 has an annular wall 76 which is received in the cup 68 of the plunger 52, and also a larger diameter annular wall 78 having a rim, the wall being joined to the smaller diameter wall 76 by a conical wall 80. In the wall 80 are lanced projections 82 adapted to engage a contact or seat 84, FIG. 12, of the housing part 12, the seat being of generally conical configuration. The contact 84 can be considered an electrical terminal since it is electrically at the potential of the remainder of the housing part 12. The bottom transverse wall 86 of the switching abutment means or cup 74 has a central aperture 88, as shown in FIGS. 9–11, and when the switch is assembled as in FIG. 1, a central projection 90 disposed at the transverse wall 72 of the plunger cup 68 can project through the aperture 88 and also constitute a pivot for the cup 74. The projection 90 has a tapered inner end 92, shown as being of generally conical configuration, and disposed at the base of the cone is an annular shoulder 94 which constitutes a seat for a compression coil spring to be described below. A lead-in surface 96 on the rim of the plunger cup 68 facilitates insertion of the contact cup 74 during assembly.

Figure 20:
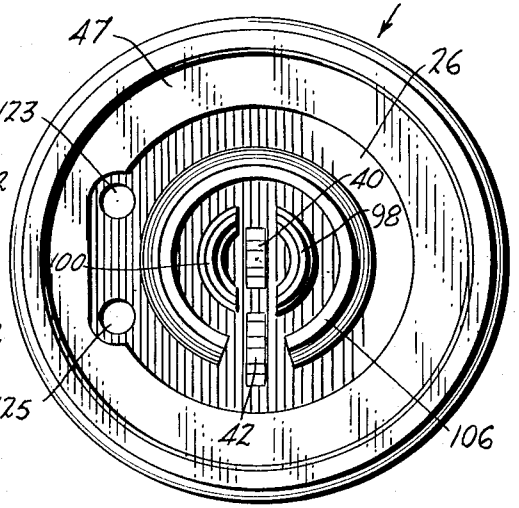
FIG. 20 is a right end elevation of the housing portion of FIGS. 17–19, employed with the switch of FIGS. 1–3.
Figure 18:
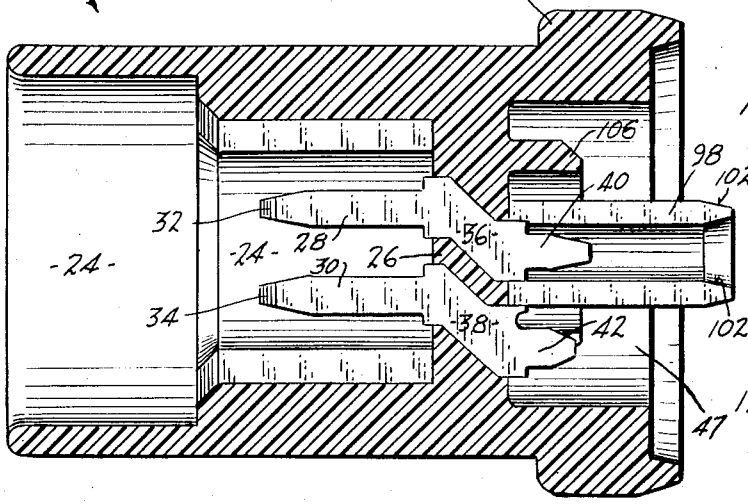
FIG. 18 is an axial section of the housing portion of FIG. 17, taken at 90° with respect thereto.

On the inner surface of the transverse wall 26 of the insulating housing part 14 is a pair of upstanding projections 98 and 100, each preferably being in the form of a section of a cylinder. The ends of the projections are tapered, as at 102 and 104, in order to provide a lead-in for installation of the springs to be described. The inner surface of the wall 26 of the housing 14 also has a cylindrical projection 106, which constitutes a stop shoulder engageable with the contact cup 74 when the latter is shifted by the plunger 52 to the relative positions of FIG. 3. This stop shoulder 106 is best illustrated in FIG. 20. It has a generally cylindrical form, but with an elongate notch to provide clearance for the inner portion 42 of the stamping.

Figure 4:
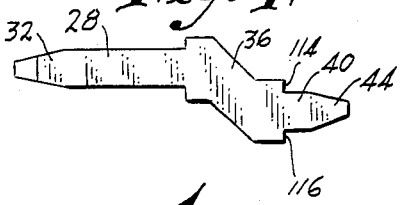
FIG. 4 is a plan view of one of the electrical terminal and connector means employed in the switch of FIGS. 1–3.
Figure 5:
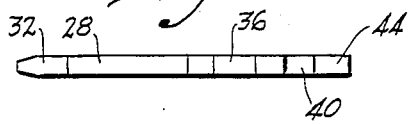
FIG. 5 is an edge view of the terminal and connector means of FIG. 4.

Referring again to FIGS. 1–3, the two compression springs are designated by the numerals 108 and 110, these being concentric and coaxial with one another. The outer spring 110 has its one end located in the recess formed by the cylindrical projection 106, while the inner spring 108 has its one end located in another recess formed by the two semi-cylindrical projections 98 and 100. The outer spring 110 is also received in a notch 112 formed in the portion 42 of the stamping, so as to establish good electrical contact therewith, while the inner spring 108 engages two opposed shoulders 114 and 116 on the other portion 40, as shown in FIG. 4. The springs 108, 110 thus establish a good electrical contact with the terminals 28, 30 respectively, as can be readily understood. The lead-in formations or tapered portions 44, 46 facilitate initial installation of the parts of the switch housing and assist the springs 108, 110 in seating properly.

With the above arrangement, it can be seen that with the plunger 52, springs 108, 110 and abutment means or cup 74 in the relative positions of FIG. 1, there is established continuity between each of the terminals 28 and 30, through the respective springs 108, 110 to the abutment means 74 and thence to the conductive portion or seat 84 of the housing part 12. The springs 108, 110 bias the parts to the position shown in FIG. 1, hereinafter known as the closed circuit position. The rim of the cup 74 is disposed at the entrance to the recess 47, as illustrated.

FIG. 2 illustrates the relative positions of the various parts as the plunger 52 is initially depressed from the position of FIG. 1 toward that of FIG. 3. When the plunger 52 is first moved, the inner spring 108 is unseated from the cup 74 as shown, thereby interrupting the circuit from the housing part 12 to the one electrical terminal 28. Continuity between the housing part 12 and the other terminal 30 is maintained, however, since no movement of the cup or abutment means 74 with respect to the housing has occurred. Continued depressing movement of the plunger will now result in the cup 68 of the plunger 52 engaging and axially moving the cup 74, which will unseat the latter from the housing part 12 and thereby interrupt the circuit between the part 12 and the other electrical terminal 30. The plunger 52 and cup 74 can be further depressed until the latter engages the stop shoulder 106 as in FIG. 3. It is noted that even after such engagement occurs, a small space exists between the bottom of the contact cup 74 and the ends or tips of the projections 98, 100. The shoulder 106 thus tends to protect the projections 98, 100 against damage or breakage as otherwise might result from a depressing force of excessive magnitude being inadvertently applied to the plunger.

It is to be noted that the switching is accomplished in sequence, that is, first the terminal 28 is isolated from the other terminal 30 and housing part 12 by projection 90, constituting a device that separates the one coil spring 108 from the cup 74, and then the remaining terminal 30 is isolated. At no time is there established a condition where the two terminals 28 and 30 are connected to one another and not to the housing part 12. Such an arrangement can have important advantages where is it absolutely necessary to maintain open circuit isolation between the terminals 28 and 30. Generally it is assumed that the housing part 12 would be connected to electrical ground, through its mounting to a chassis or vehicle ground, but other applications are possible. For example, if the metal housing part 12 were to be mounted on an insulating surface, the switch would become a single pole, single throw type with respect to terminals 28 and 30.

During the movement of the plunger 52 it will be understood that air can pass through the passages 64 and 66 and past the O-ring 62 in order to balance the pressures on opposite sides of the ring 62 and thus eliminate the piston effect of the plunger. Such an effect might otherwise interfere with its free movement.

Further, in accordance with the invention, the plurality of outwardly lanced portions 82 shown in FIGS. 9–11, constitute contact projections that are adapted to engage the annular nular seat 84 (FIG. 12) of the housing part 12 and provide for increased unit pressures over that which would occur were a single annular seat to be provided on the cup 74. By reducing the areas of contact between the cup 74 and the seat 84, there is effected an increased pressure per unit area between the parts, which results in an improved electrical contact and reduces the likelihood of contact degeneration over extended periods of use.

Also, in accordance with the invention, cooperable means are provided on the transverse wall 72 of the plunger 52 and on the cup 74, for effecting small increments of rotation of the latter with respect to the housing part 12 and plunger 52 as the plunger is operated. In accomplishing this object, there is provided on the surface of the transverse wall 72 of the plunger a series of recesses 122, shown as being eight in number, and each having a generally conical surface configuration. Disposed on the transverse wall 86 of the cup 74 is a series of nibs or protrusions 124, shown as being four in number. As can be readily seen, the eight recesses 122 are disposed circumferentially 45° from one another, and are symmetrical with respect to the axis of the plunger 52. On the cup 74 the protrusions 124 are shown as being in two sets of diametrically opposed pairs. The circumferential disposition between two of the adjacent protrusions 124 is 67.5°, which figure was derived by multiplying 45° by 1.5.

With such arrangement, it has been found that when initial engagement of the cup 74 with the transverse wall 72 of the plunger cup 68 occurs, it is unlikely that either of the pairs of protrusions 124 will align exactly with any of the opposed pairs of the recesses 122. Accordingly, assuming that the plunger 52 is not subject to any significant rotation while it is being forcibly depressed, the contact cup 74 will rotate until one pair of protrusions 124 does seat in a corresponding pair of recesses 122, at which time the remaining pair of protrusions 124 will be disposed precisely between a pair of adjoining recesses 122. As presently understood, the deliberate misalignment between the protrusions 124 and recesses 122 will give rise to a slight rotation or turning of the cup 74 each time that the switch plunger 52 is actuated. As a result, different parts of the cup 74, namely different ones of the fingers 82 will come to rest in different places on the conical seat 84 of the housing part 12 at the time that the plunger 52 is released. Stated differently, when the plunger 52 is depressed, the cup 74 will rotate slightly, in either direction. Upon release of the plunger 52, the cup 74 will return to the position of FIG. 1, but with a slightly different angular orientation, and the contact areas between the cup 74 and seat 84 will be correspondingly different. It is believed that this construction leads to improved contact life by reducing the likelihood of wear of the contact surfaces, resulting from repeated like engagement and disengagement therebetween. In some respects the action of the cup 74 on the seat 84 can be thought of as similar to a wiping action which occurs in some electromechanical devices, and which is purposely introduced in such devices in order to reduce the effects of oxidation on the contacts.

Figure 19:
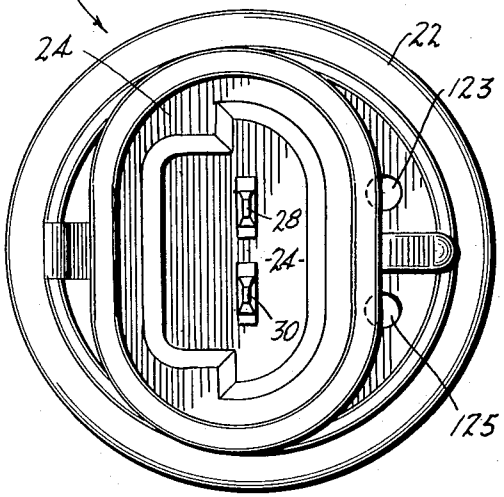
FIG. 19 is a left end elevation of the housing portion of FIGS. 17 and 18, employed with the switch of FIGS. 1–3.

As an alternative to providing the passages 64 and 66 in the plunger 52 at locations adjacent the O-ring 62, the present invention embraces the provision, in the plastic housing part 14, of one or two vent holes that provide communication between the bore 50 of the housing and the exterior thereof. Two such vent passages 123 and 125 are shown in FIGS. 19 and 20; it is believed that by making such passages sufficiently small, adequate pressure equalization can be provided on the initial depression of the plunger, while at the same time minimizing the possibility of dirt or other debris entering the interior of the housing, and contaminating the areas of contact between the connector portions or means 40, 42, the springs 108, 110, and between the springs 108 and 110 and the cup 74, as well as between the cup 74 and its seat 84. As can be readily understood, either venting arrangement can be employed, or both, if desired.

Another embodiment of the invention is shown in FIGS. 22–30, involving a modified plunger construction adapted to be substituted for the plunger 52 of FIGS. 1–3 and 6–8. The modified plunger is designated 52*a*, and has a transverse wall 72*a* constituting the bottom of a cup-like end structure or calibrating cavity to be described below. As in the previous embodiment, the inner end of the plunger 52*a* has a cup structure 68*a* which receives and constitutes a seat for the contact cup 74 of FIGS. 9–11. The modified plunger 52*a* also has a transverse annular groove 60*a*, similar to the groove 60, which is adapted to receive a sealing O-ring. Small passages 64*a*, 66*a* are provided, constituting vents, to enable gas occupying the area within the switch housing to be expelled when the plunger 52*a* is initially depressed, thereby minimizing the piston effect thereof, as explained previously.

By the present invention the plunger is constituted of two separate parts, enabling the length of the composite plunger to be automatically self-calibrating to a predetermined desired figure based on the dimensions and clearances of the environment in which the switch is to be employed. The plunger parts are designated 126 and 128, respectively, and have an interference or press fit with one another such that under application of a predetermined force applied to the part 128, it can retract with respect to the part 126. The plunger thus constitutes a take-up mechanism which can compensate for dimensional variations resulting from installations having differing physical sizes. There is thus avoided possible damage to the plunger parts, or to the switch housing or switch contacts.

The part 126 has a cup-like end configuration defining a calibrating cavity 130 with an annular side wall 132. The cavity 130 is provided with four longitudinal passages 134 which provide clearance spaces for four corresponding vane-like structures 136 on the other plunger part 128. In the disclosed embodiment the press-fit occurs between the four surfaces 138 constituting the small diameter portion of the bore, and the corresponding four circumferential surfaces 140 on the other plunger part 128 which are disposed between the four vanes 136. As shown, the vanes 136 have a generally triangular cross-sectional configuration, and are received in the longitudinal passages 134 of the plunger part 126, so as to key the parts 126, 128 with respect to one another. There is preferably a small pressure between the longitudinal edges of the vanes 136 and the adjacent, cylindrical surfaces of the passages 134, but the vanes are not sufficiently rigid to provide any substantial degree of controlling frictional engagement between the parts 126, 128.

As shown the plunger part 128 has a generally conical lead-in surface 141 that is cooperable with lead-in segments 142 that are sections of a cone on the part 126, in order to facilitate initial assembly. These surfaces are particularly shown in FIGS. 22, 25 and 27. Similar lead-in surfaces are provided on the inner ends of the vanes 136, and on the lip of the calibrating cavity 130 of the plunger part 126.

Figure 22:
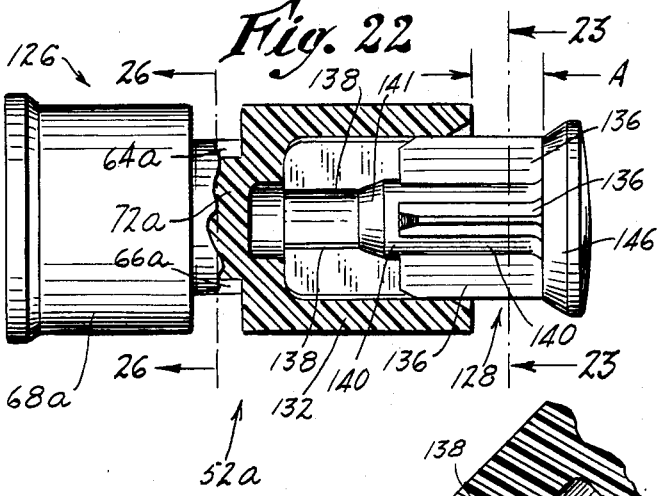
FIG. 22 is a view, partly in elevation and partly in axial section, of a two-part automatically calibrating plunger adapted to be substituted for that shown in the switch mechanism of FIGS. 1–3, this construction constituting another embodiment of the invention.
Figure 23:
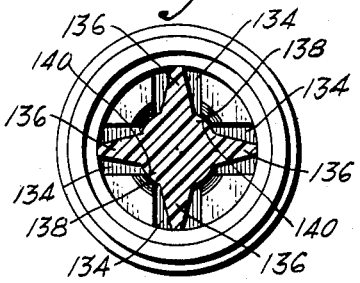
FIG. 23 is a section taken on the line 23—23 of FIG. 22.
Figure 25:
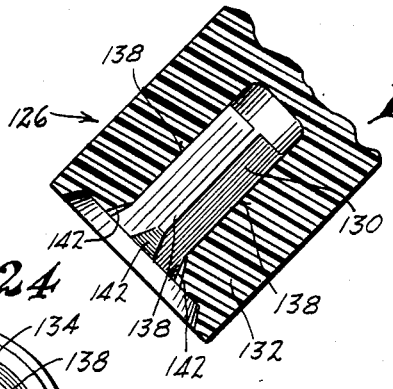
FIG. 25 is a section taken on the line 25—25 of FIG. 24.
Figure 24:
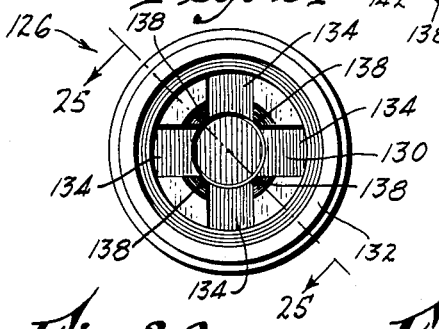
FIG. 24 is a right end elevation of one part of the plunger shown in FIGS. 22 and 23.
Figure 26:
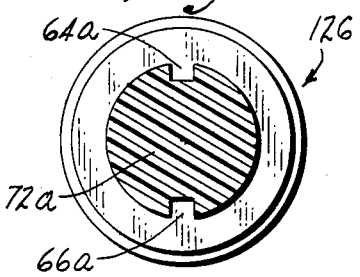
FIG. 26 is a section taken on the line 26—26 of FIG. 22.
Figure 28:
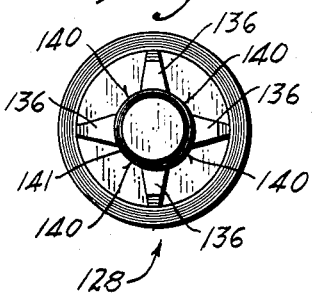
FIG. 28 is a left end elevation of the plunger part of FIG. 27.
Figure 27:
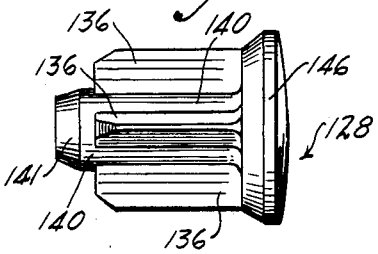
FIG. 27 is a side elevation of the other part of the plunger shown in FIGS. 22 and 23.
Figure 29:
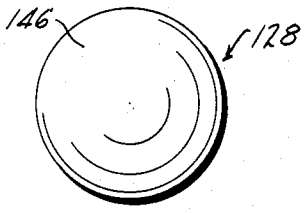
FIG. 29 is a right end elevation of the plunger part of FIGS. 27 and 28.
Figure 30:
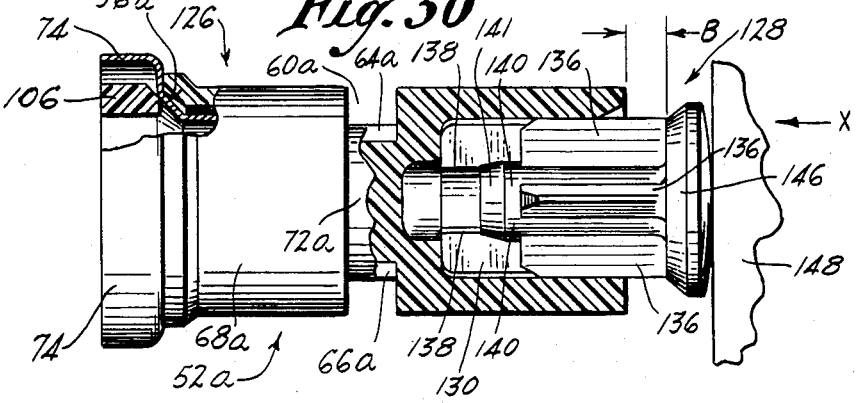
FIG. 30 is a view similar to FIG. 22, except showing the plunger parts as having been relatively retracted partially, due to force applied by an actuator member.

The plunger part 128 preferably has an enlarged button 146 at its outer end, constituting shoulder means that is adapted to be engaged by an abutment member 148, as in FIG. 30. In FIG. 22, the plunger parts 126, 128 are shown as occupying a first position wherein they are mostly extended with respect to one another, but there exists a sufficient retention such that the parts will not loosen. FIG. 30 shows the abutment member 148 having been forcibly moved in the direction indicated by the capital letter "X", wherein it has engaged the button 146 and shifted or retracted the plunger part 128 into the plunger part 126. The shifting occurs along a linear path, and parallel to the axes of the plunger parts, as can be readily seen. The distance indicated by the capital letter "A" in FIG. 22 has, in FIG. 30, been reduced to the dimension "B". This has occurred because the plunger comprising both parts 126, 128 was initially depressed until the contact cup 74 that was being driven by the shoulder 96*a*, arrived at the stop shoulder or abutment 106 as in FIG. 30, while force was still being applied to the plunger part 128. Where the applied force exceeds a predetermined, desired figure the relative adjustment of the part 128 will occur automatically, thus providing the proper dimension to the overall length represented by the telescoped plunger parts 126, 128. The dimension "B" in FIG. 30 could be reduced further than that shown, as required by the final position of the member 148. Thus the switch plunger is seen to be self-adjusting as to its overall length, with such adjustment occurring automatically after the switch device has been permanently installed in its ultimate position.

It is believed that in the absence of an automatic calibration arrangement such as set forth in FIGS. 22–30, there might occur damage to the switch. That is, if the switch housing were to be rigidly mounted to a supporting surface in the engine compartment of a vehicle, with the plunger adapted for engagement by a surface 148 on the underside of the hood, great care would have to be exercised in order to insure that forcible closing or slamming of the hood did not depress the plunger to the extent that it would be crushed. Thus the tolerances of various mechanical parts on the vehicle would have to be monitored to a considerably greater extent, more so than is considered warranted at the present time.

The modified construction illustrated in FIGS. 22–30 has the following important advantage. By incorporating an arrangement whereby the overall length of the plunger can be automatically adjusted after the unit is installed in its particular environment, only minimal consideration need be given to tolerances relating to the absolute length of the plunger and switch housing assembly. Very often such tolerances are difficult to control. In the present switch plunger arrangement, reliance is placed mostly on obtaining a close tolerance on the diameter of the bore of the one plunger part 126 on the one hand, and the outer diametric or circumferential surface of the cooperable plunger part 128, on the other. Diametric or circumferential dimensions, as provided herein, can be closely held and controlled, as compared with linear or like dimensions, and this is a feature of the invention. Where such parts are constituted of molded plastic, it is relatively easy to control tolerances of this nature, much more so than attempting to monitor dimensional variations involving the overall length of a completed switch assembly, where multiple individual, separate pieces are employed. It is thus considered that the plunger arrangement which has been disclosed constitutes a important aspect of the switch mechanism of the present invention.

From the above it can be seen that we have provided a novel and improved switch construction which is simple in its structure and both rugged and reliable over extended periods of use. The likelihood of contact deterioration is minimized by the use of a sealed-type switch housing, whereby accumulation of moisture and debris is minimized. The rotation or turning movement of the cup during operation of the switch is believed to be an important feature as regards maintenance of contact integrity.

Assembly of the switch can be automated, if desired, and the overall manufacturing expense minimized through the use of relatively simple molded plastic pieces, and stamped sheet metal parts. The device is thus seen to represent a distinct advance and improvement in the field of electrical switches.

Each and every one of the appended claims defines an aspect of the invention which is separate and distinct from all others, and accordingly each claim is intended to be treated in this manner when examined in light of the prior art devices in any determination of novelty or validity.

Variations and modifications are possible without departing from the spirit of the invention.

What is claimed is:

1. An electric switch comprising, in combination:
(a) a housing comprising an insulating part and a conductive metal part,
(b) a pair of electrical terminals,
(c) said housing insulating part mounting said terminals in side-by-side relation to one another,
(d) a pair of compression, electrically-conducting coil springs in said housing, disposed coaxially one within the other,
(e) means carried by the housing, electrically connecting one pair of corresponding ends of said springs respectively to said terminals,
(f) a movable electrically-conducting abutment means in said housing, said abutment means detachably electrically connecting the other pair of corresponding ends of the coil springs to each other and being movable between circuit closing and circuit opening positions,
(g) said housing conductive metal part having an inner electrical conductive surface engageable with said abutment means to effect electrical connection therewith when the abutment means is in its circuit closing position, whereby said inner conductive surface is used as a common carrier for currents passing through said abutment means and terminals, and
(h) manually-operable means on the housing, movable between circuit opening and circuit closing positions and engageable with the said abutment means to shift said abutment means to its circuit opening position,
(i) said abutment means closing a circuit between the inner conductive surface and said other pair of spring ends when it is in engagement with the inner conductive surface whereby current can flow to the conductive metal part of the housing from said terminals, and said abutment means breaking said circuit when it is separated from said inner conductive surface by said manually-operable means.

2. An electric switch as set forth in claim 1, and further including:
(a) circuit opening means responsive to movement of said manually-operable means toward its circuit opening position, for electrically disconnecting said other pair of corresponding ends of the coil springs from each other.

3. An electric switch as set forth in claim 2, wherein:
(a) said circuit opening means disconnects the said other pair of coil spring ends from each other prior to any movement of the said abutment means.

4. An electric switch as set forth in claim 2, wherein:
(a) said circuit opening means disconnects the said other pair of coil spring ends from each other prior to said abutment means becoming disengaged from said inner conductive surface.

5. An On-Off electric switch comprising, in combination:
(a) a housing comprising an insulating part and a conductive metal part,
(b) a fixed electric terminal mounted in the housing insulating part,
(c) a movable contactor mounted in the housing and movable between circuit closing and circuit opening positions,
(d) resilient means for electrically connecting said fixed electrical terminal with the movable contactor and for imparting a bias to the latter,
(e) said conductive metal part of the housing being engageable by said movable contactor, and
(f) manually-operable means for actuating said movable contactor between its circuit closing and circuit opening positions,
(g) said conductive metal part of the housing being positively engaged by said contactor in the circuit closing position,
(h) a second electric terminal, and
(i) means electrically connecting said second electric terminal with the movable contactor,
(j) the means electrically connecting the terminals to the movable contactor comprising a pair of electrically conducting compression springs engaged with the contactor and respectively connected with the terminals.

6. An electric switch as set forth in claim 5, wherein:
(a) said pair of springs are coaxial and concentrically disposed one within the other.

7. An On-Off electric switch comprising, in combination:
(a) a housing comprising an insulating part and a conductive metal part,
(b) a fixed electric terminal mounted in the housing insulating part,
(c) a movable contactor mounted in the housing and movable between circuit closing and circuit opening positions,
(d) resilient means for electrically connecting said fixed electrical terminal with the movable contactor and for imparting a bias to the latter,
(e) said conductive metal part of the housing being engageable by said movable contactor,
(f) manually-operable means for actuating said movable contactor between its circuit closing and circuit opening positions,
(g) said conductive metal part of the housing being positively engaged by said contactor in the circuit closing position,
(h) a second electric terminal, and
(i) means electrically connecting said second electric terminal with the movable contactor,
(j) said housing insulating part mounting said second terminal, said housing insulating part having a recess in one face,
(k) said contactor being annular and received in the recess of said housing insulating part and being axially movable into said recess from its circuit closing to its circuit opening position.

8. An electric switch as set forth in claim 7, wherein:
(a) said contactor comprises a cup,
(b) the rim portion of said cup being movable into the recess of said housing insulating part.

9. An electric switch as set forth in claim 8, wherein:
(a) the means electrically connecting the terminals with the movable contactor comprises a pair of electrically-conducting compression springs,
(b) said springs having end portions which are nested in the contactor cup.

10. An electric switch as set forth in claim 8, and further including:
(a) means disposed in the recess of the housing insulating part providing a stop shoulder engageable with the contactor cup when the latter is moved toward the bottom of the recess.

11. An On-Off electric switch comprising, in combination:
(a) a housing comprising an insulating part and a conductive metal part,
(b) a fixed electric terminal mounted in the housing insulating part,
(c) a movable contactor mounted in the housing and movable between circuit closing and circuit opening positions,
(d) resilient means for electrically connecting said fixed electrical terminal with the movable contactor and for imparting a bias to the latter,
(e) said conductive metal part of the housing being engageable by said movable contactor, and
(f) manually-operable means for actuating said movable contactor between its circuit closing and circuit opening positions,
(g) said conductive metal part of the housing being positively engaged by said contactor in the circuit closing position,
(h) a second electric terminal, and
(i) means electrically connecting said second electric terminal with the movable contactor,
(j) said manually-operable means comprising a plunger slidably mounted in the housing,
(k) said means electrically connecting the terminals with the movable contactor comprising an electrically conducting compression coil spring connected with one terminal and with the contactor, and biasing the contactor to said circuit closing position.
(l) said plunger being engaged with said contactor and having the bias thereof imparted to it by the contactor.

12. An electric switch as set forth in claim 11, wherein;
(a) said second terminal is mounted in the housing insulating part,
(b) said housing insulating part having a recess in one face,
(c) said plunger having a recess in one end,
(d) said contactor comprising a cup having a rim portion receivable in the recess of the housing insulating part, and having a body portion movable in the recess of said plunger.

13. An electric switch as set forth in claim 11, wherein:
(a) said plunger has a recess,
(b) said contactor comprising a cup in the recess of the plunger and bearing means on the plunger and cup enabling the cup to rotate with respect to the plunger.

14. An On-Off electric switch comprising, in combination:
(a) a housing comprising an insulating part and a conductive metal part,
(b) a fixed electric terminal mounted in the housing insulating part,
(c) a movable contactor mounted in the housing and movable between circuit closing and circuit opening positions,
(d) resilient means for electrically connecting said fixed electrical terminal with the movable contactor and for imparting a bias to the latter,
(e) said conductive metal part of the housing being engageable by said movable contactor,
(f) manually-operable means for actuating said movable contactor between its circuit closing and circuit opening positions,
(g) said conductive metal part of the housing being positively engaged by said contactor in the circuit closing position, and
(h) means for electrically isolating said terminals from each other during the circuit opening actuation of the contactor by said manually-operable means,
(i) said means electrically connecting the terminals with the movable contactor comprising a pair of electrically-conducting compression coil springs,
(j) said manually-operable means for actuating said movable contactor being engageable during its operating movement with one of said coil springs,
(k) said isolating means separating said one coil spring from the contactor during the circuit opening actuation thereof whereby the said terminals are electrically disconnected from each other during such actuation.

15. An electric switch comprising, in combination:
(a) a housing comprising an insulating part and a conductive metal part,
(b) a pair of electrical terminals,
(c) said housing insulating part mounting said terminals in side-by-side relation to one another,
(d) a pair of compression, electrically-conducting coil springs in said housing, disposed coaxially one within the other,
(e) means carried by the housing insulating part, electrically connecting one pair of corresponding ends of said springs respectively to said terminals,
(f) a movable electrically-conducting abutment means in said housing, for detachably electrically connecting the other pair of corresponding ends of the coil springs to each other, said abutment means being movable between circuit closing and circuit opening positions, and
(g) manually-operable means on the housing, movable between circuit opening and circuit closing positions and engageable with the said abutment means to shift the latter between its circuit closing and circuit opening positions,
(h) said connecting means being laterally offset with respect to the terminals, such that the terminals can be substantially symmetrically disposed with respect to the axis of the said springs.

16. An electric switch, comprising in combination:
(a) a housing,
(b) a pair of electrical terminals,
(c) inner and outer compression coil springs, said springs being carried in the housing and having adjacent ends respectively connected with said terminals, (d) a movable electrically conductive abutment member having two spring seats, respectively receiving the other ends of the said springs, and being biased thereby, (e) said abutment member having an aperture adjacent the location of the seat for the inner spring, (f) a plunger carried by the housing and movable between circuit opening and circuit closing positions, (g) said plunger being capable of shifting the movable abutment member against the biasing force of the springs, (h) said plunger having a projection receivable in the aperture of the abutment member, said projection having an annular shoulder constituting an additional seat to receive the said other end of the inner spring when the plunger is moved toward its circuit opening position, whereby upon movement of the plunger toward the said circuit opening position, the shoulder of the plunger lifts the said other end of the inner spring from its seat on the movable abutment member, prior to shifting the movable abutment member.

17. An electric switch, comprising in combination:

(a) a housing having an electrical conductor comprising a stationary contact seat of generally annular configuration, (b) a second conductor, movable with respect to the first conductor, said second conductor having a contact surface for engagement with said annular contact seat to establish electrical contact therewith, (c) means biasing said second conductor into engagement with said annular contact seat, (d) a plunger carried by the housing, for effecting movement of said second conductor away from said annular contact seat to interrupt said electrical contact, (e) said second conductor comprising a contact cup having integrally formed radially-outwardly protruding lugs facing said contact seat for engagement with limited areas thereof, whereby increased contact pressure between said lugs and contact seat can be realized.

18. An electric switch, comprising in combination:

(a) a switch housing comprising an insulating portion and a conductive portion, said switch being secured to an electrically conductive mounting surface, (b) a threaded barrel carried by the conductive portion of the housing, (c) an electrical terminal carried by the insulating portion of the housing, (d) a manually operable actuator member accessible from outside the housing and having a portion extending into the housing barrel and being movable therein, (e) electrical contact means engageable by the actuator member, for making and breaking an electrical connection between the said terminal and the conductive portion of the housing, and (f) means providing an external projection integral with the conductive portion of the housing, and disposed adjacent the threaded barrel thereon, for breaking through and puncturing any non-electrically conductive coating on the said mounting surface for the switch, thereby establishing electrical continuity between the said mounting surface and the conductive portion of the housing, (g) said projection means comprising an upstanding tooth sheared from the surface of the conductive portion of the housing.

* * * * *